US007454156B2

(12) United States Patent
Wakiyama

(10) Patent No.: US 7,454,156 B2
(45) Date of Patent: Nov. 18, 2008

(54) IMAGE FORMING APPARATUS

(75) Inventor: Eiji Wakiyama, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 502 days.

(21) Appl. No.: 11/376,298

(22) Filed: Mar. 16, 2006

(65) Prior Publication Data

US 2006/0221168 A1 Oct. 5, 2006

(30) Foreign Application Priority Data

Mar. 25, 2005 (JP) ..... 2005-088418
Feb. 1, 2006 (JP) ..... 2006-024572

(51) Int. Cl.
*G03G 21/16* (2006.01)

(52) U.S. Cl. ..... 399/111; 399/114

(58) Field of Classification Search ..... 399/107, 399/108, 110, 111, 113, 114, 124, 125
See application file for complete search history.

(56) References Cited

U.S. PATENT DOCUMENTS 6,125,251 A 9/2000 Shiraishi et al.
6,973,279 B2 * 12/2005 Yokoi ..... 399/124
7,006,776 B2 * 2/2006 Matsuzaka et al. ..... 399/111
7,203,448 B2 * 4/2007 Yokoi ..... 399/124
7,341,387 B2 * 3/2008 Nishimura et al. ..... 400/693

FOREIGN PATENT DOCUMENTS

JP 08-16062 1/1996
JP 11-296048 10/1999
JP 2000-039827 2/2000
JP 2000-112195 4/2000

* cited by examiner

*Primary Examiner*—Hoan H Tran
(74) *Attorney, Agent, or Firm*—Fitzpatrick, Cella, Harper & Scinto

(57) ABSTRACT

An image forming apparatus includes a first opening and closing device provided in an apparatus body and openable and closable with respect to the apparatus body, an operating member operable by a user to open the first opening and closing device, a first recess for receiving the hand of the user and to permit the hand to contact and operate the operating member to open the first opening and closing device, and a second recess for receiving the hand of the user and to permit the hand to contact and operate the operating member to open the first opening and closing device when the hand of the user is inserted thereinto. The second recess is located at a position different from the first recess.

19 Claims, 4 Drawing Sheets

IMAGE FORMING APPARATUS

BACKGROUND OF THE INVENTION

1. Field of the Invention

The present invention relates to an image forming apparatus such as a photocopier, a printer, a facsimile, or the like, and more specifically, it relates to an apparatus having an opening and closing device that can be opened and closed in relation to the apparatus body.

2. Description of the Related Art

An image forming apparatus has opening and closing covers that can be opened and closed in relation to the apparatus body. A typical example of such opening and closing covers is a cartridge cover described in, for example, Japanese Patent Laid-Open No. 8-16062 and opened when the user replaces a process cartridge for forming an image. In addition, such opening and closing covers include a feeding tray cover on which sheets to be fed are loaded, a discharge tray cover on which discharged sheets are loaded, and a jammed-sheet removing cover for removing a sheet jammed in the apparatus body.

Some of such opening and closing covers have a handle used to open or close the cover, and a latch provided in the handle. The latch moves in conjunction with a hook fastening the cover to the apparatus body, and is used to disengage the hook.

The handle and the latch are located on one surface of the apparatus body (for example, on the front surface (the surface facing the operator)), and the opening and closing operation of the opening and closing cover can be performed from one direction (from the front) in relation to the apparatus body.

The above-described opening and closing covers have a problem where the operator who is going to operate the latch can insert their hand in the handle by mistake and fail to disengage the hook. In addition, in the case where a member covers the latch, it can be difficult to operate the latch.

SUMMARY OF THE INVENTION

The present invention provides an image forming apparatus having improved accessibility to an operating member for opening an opening and closing device.

According to one aspect, the present invention relates to an image forming apparatus comprising an image forming device, a first opening and closing device, an operating member, and first and second recesses. The image forming device is provided in an apparatus body of the image forming apparatus and configured to form an image on recording material. The first opening and closing device is provided in the apparatus body and configured to be opened and closed with respect to the apparatus body. The operating member is operable by a user and configured to open the first opening and closing device in response to the user operating the operating member. The first recess is configured to receive the hand of the user and to permit the hand of the user to contact and operate the operating member to open the first opening and closing device with respect to the apparatus body after the hand of the user is inserted thereinto. The second recess is configured to receive the hand of the user and to permit the hand of the user to contact and operate the operating member to open the first opening and closing device with respect to the apparatus body after the hand of the user is inserted thereinto, the second recess being located at a position different from the first recess.

The apparatus can further comprise a discharging portion configured to discharge the recording material after an image is formed thereon and an extension member. The discharging portion and the first recess are provided in the same surface of the apparatus body. The extension member extends from the discharging portion toward the first recess.

The first recess and the second recess are provided in different surfaces of the apparatus body.

In addition, the operating member has a first operating part and a second operating part, the first operating part being located in the first recess, and the second operating part being located in the second recess.

The first opening and closing device can be configured to be fixed to and released from being fixed to the apparatus body. In this case, the operating member is configured to release the first opening and closing device from being fixed to the apparatus body in response to the user operating the operating member to permit the first opening and closing device to open. In addition, the first recess is configured to receive the hand of the user and to permit the hand of the user to contact and operate the operating member to release the first opening and closing device from being fixed to the apparatus body after the hand of the user is inserted thereinto. Also, the second recess is configured to receive the hand of the user and to permit the hand of the user to contact and operate the operating member to release the first opening and closing device from being fixed to the apparatus body after the hand of the user is inserted thereinto.

The image forming device can comprise a detachable process cartridge configured to form an image on the recording material, wherein the process cartridge is attachable to and detachable from the apparatus body after the user opens the first opening and closing device.

The image forming apparatus further comprises a second opening and closing device provided in the apparatus body and configured to be opened and closed with respect to the apparatus body. The second opening and closing device is different from the first opening and closing device, and the second recess is configured to permit the hand of the user to contact and operate the second opening and closing device to open the second opening and closing device with respect to the apparatus body after the hand of the user is inserted thereinto.

In addition, the second opening and closing device is configured to receive the recording material and to feed the recording material.

In one embodiment, the first opening and closing device opens in approximately the same direction as the second opening and closing device, while in another embodiment the first opening and closing device opens in approximately the opposite direction from the second opening and closing device.

The second opening and closing device can comprise an operating portion, and in this case, the second recess is configured to permit the hand of the user to contact and operate the operating portion of the second opening and closing device to open the second opening and closing device after the hand of the user is inserted thereinto.

In one embodiment, the operating portion of the second opening and closing device is a handle of the second opening and closing device fixed to the second opening and closing device.

The operating member of first opening and closing device is movable with respect to the first recess and the second recess to open the first opening and closing device with respect to the apparatus body, and the handle of the second opening and closing device is not movable with respect to the second recess to open the second opening and closing device with respect to the apparatus body.

As a result, the operating member of the first opening and closing device performs a different kind of opening operation with respect to the second recess than the operating portion of the second opening and closing device.

The second opening and closing device further comprises a hook having an elastic member configured to releasably engage a portion of the apparatus body, and a handle, wherein the handle and the hook are connected to each other such that movement of the handle in at least one direction by the user releases the engagement between the hook and the portion of the apparatus body engaged with the hook.

Also, the first opening and closing device comprises a hook configured to releasably engage a portion of the apparatus body, and its operating member comprises a latch, the latch and the hook being connected to each other such that movement of the latch in at least one direction by the user releases the engagement between the hook and the portion of the apparatus body engaged with the hook.

According to another aspect, the image forming apparatus comprises image forming means for forming an image on recording material and provided in an apparatus body of the image forming apparatus, first opening and closing means for opening and closing with respect to the apparatus body, manual operating means, operable by a user, for opening the first opening and closing means with respect to the apparatus body in response to the user operating the manual operating means, first receiving means for receiving the hand of the user and for permitting the hand of the user to contact and operate the manual operating means to open the first opening and closing means with respect to the apparatus body after the hand of the user is inserted thereinto, and second receiving means for receiving the hand of the user and for permitting the hand of the user to contact and operate the manual operating means to open the first opening and closing means with respect to the apparatus body after the hand of the user is inserted thereinto. The second receiving means is located at a position different from the first receiving means.

The first opening and closing means can comprise means for being fixed to the apparatus body and for being released from being fixed to the apparatus body. In this case, the manual operating means comprises means for releasing the first opening and closing means from being fixed to the apparatus body in response to the user operating the manual operating means to permit the first opening and closing means to open, the first receiving means comprises means for receiving the hand of the user to permit the hand of the user to contact and operate the manual operating means to release the first opening and closing means from being fixed to the apparatus body after the hand of the user is inserted thereinto, and the second receiving means comprises means for receiving the hand of the user to permit the hand of the user to contact and operate the manual operating means to release the first opening and closing means from being fixed to the apparatus body after the hand of the user is inserted thereinto. Also in this case, the apparatus further comprises second opening and closing means for being fixed to and released from being fixed to the apparatus body, for opening with respect to the apparatus body when released from being fixed thereto, and for closing with respect to the apparatus body. The second opening and closing means is different from the first opening and closing means, and the second receiving means is for permitting the hand of the user to contact and operate the second opening and closing means to release the second opening and closing means from being fixed to the apparatus body after the hand of the user is inserted thereinto.

Further features of the present invention will become apparent from the following description of exemplary embodiments (with reference to the attached drawings).

DESCRIPTION OF THE EMBODIMENTS

The preferred embodiments of the present invention will now be described in detail by using examples with reference to the drawings. The sizes, materials, shapes, and relative positions of components of the embodiments should be appropriately changed depending on the configuration of the apparatus to which the present invention is applied, and various conditions. It is to be understood that the present invention is not intended to be limited to the following embodiments.

First Embodiment

Figure 1:
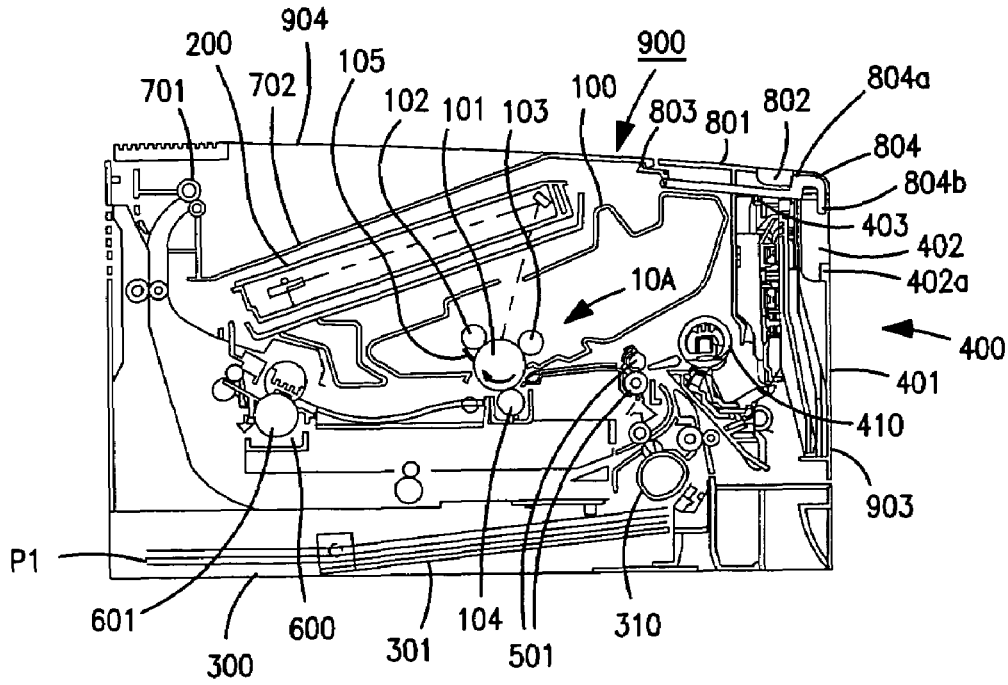
FIG. 1 is a schematic sectional view of an image forming apparatus according to a first embodiment of the present invention.
Figure 2:
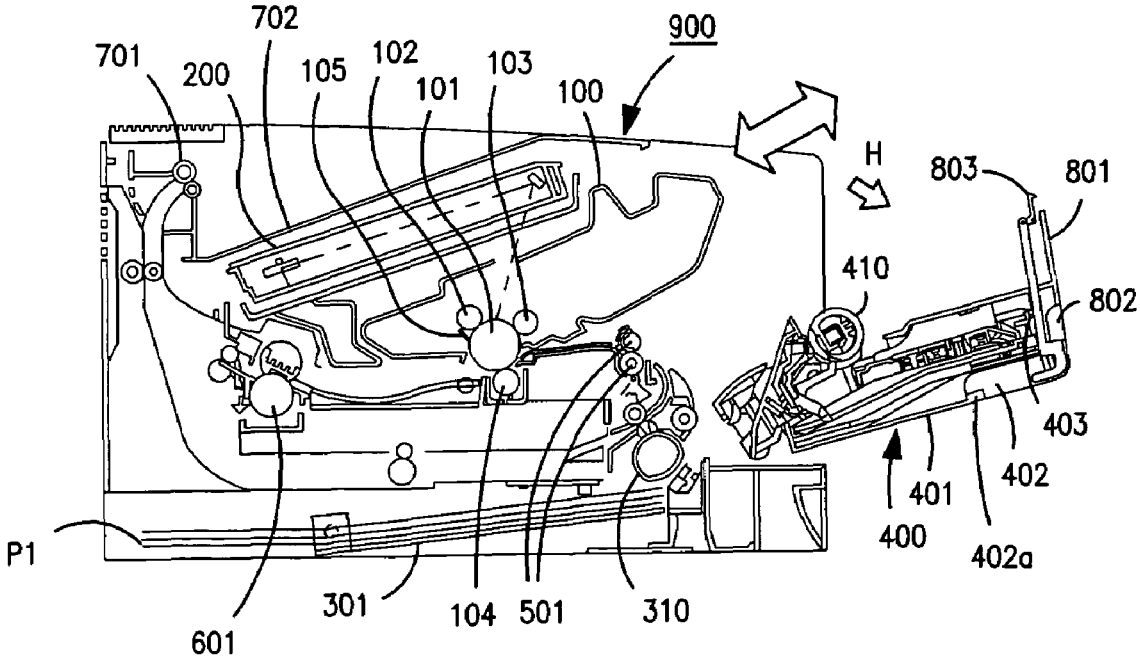
FIG. 2 is a schematic sectional view of the image forming apparatus with a first opening and closing device open.
Figure 3:
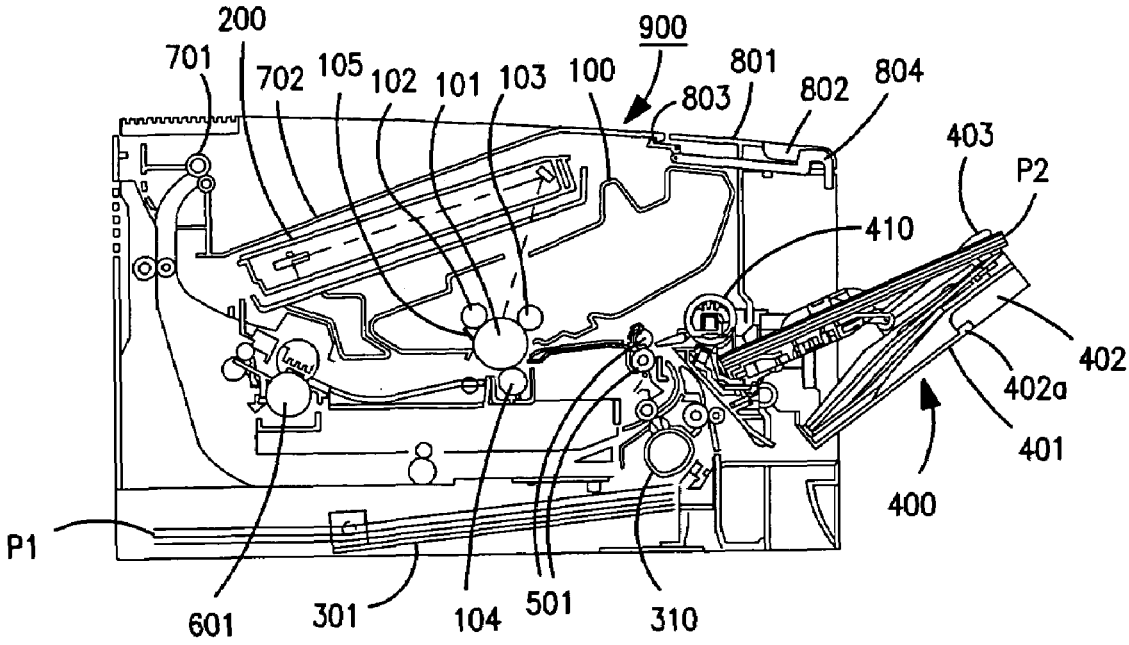
FIG. 3 is a schematic sectional view of the image forming apparatus with a second opening and closing device open.
Figure 4:
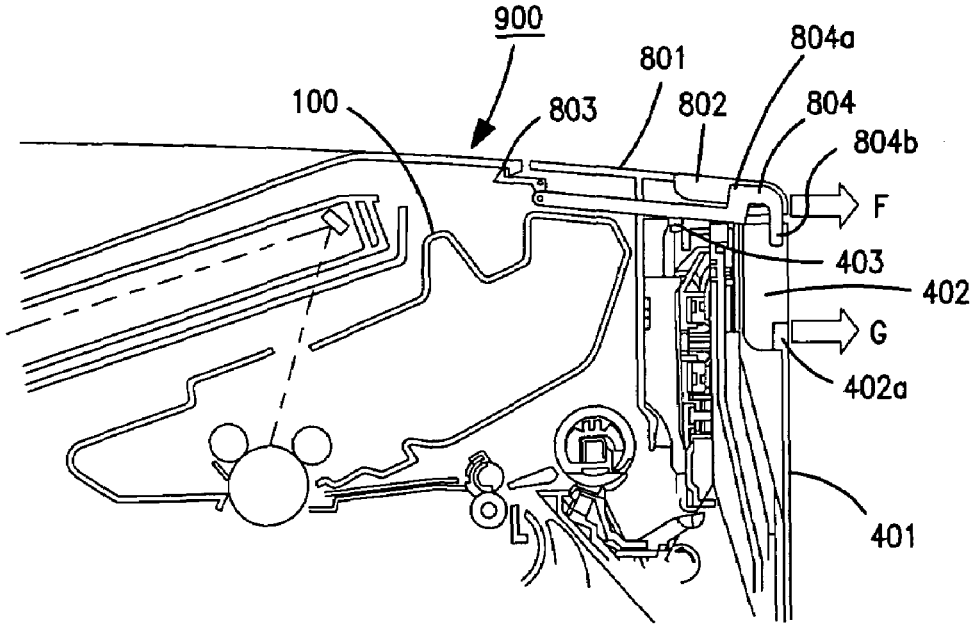
FIG. 4 is a schematic sectional enlarged view of an area including a first recess and a second recess into which the hand of the user is inserted.

FIG. 1 is a schematic sectional view showing the overall structure of an electrophotographic monochrome printer that is an example of an image forming apparatus according to a first embodiment of the present invention. FIG. 2 shows the apparatus of FIG. 1 with a cartridge cover (first opening and closing device) 801 open. FIG. 3 shows the apparatus of FIG. 1 with a feeding tray cover (second opening and closing device) 401 open. FIG. 4 is an enlarged view showing a first recess into which the hand of the user is inserted to open the first opening and closing device and a second recess into which the hand of the user is inserted to open the second opening and closing device.

First, the overall structure of the image forming apparatus will be described. Next, how the two opening and closing devices are opened will be described.

A photosensitive drum 101 serving as an image carrier is provided inside the apparatus body 900 of the image forming apparatus shown in FIG. 1. Around the photosensitive drum 101, there are arranged a charging device 102, a laser scanner 200, a developing device 103, a transferring roller 104, and a cleaning device 105 in this order in the rotation direction of the photosensitive drum 101. The charging device 102 uniformly charges the surface of the photosensitive drum 101.

A laser scanner 200 irradiates the surface of the photosensitive drum 101 with a laser beam on the basis of image information so as to form an electrostatic latent image on the surface of the photosensitive drum 101. The developing device 103 has a developing roller and attaches toner to the electrostatic latent image formed on the photosensitive drum 101, thereby developing the electrostatic latent image to form a toner image.

The transferring roller 104 serves as a transferring device that transfers the toner image on the surface of the photosensitive drum 101 onto a sheet (recording material) P1 or P2. The cleaning device 105 removes the toner remaining on the surface of the photosensitive drum 101 after the transfer. The photosensitive drum 101, the charging device 102, the laser scanner 200, the developing device 103, the transferring device 104, and the cleaning device 105 constitute an image forming part 10A.

The photosensitive drum 101, the charging device 102, the developing device 103, and the cleaning device 105 are held in a detachable cartridge and constitute a process cartridge 100.

In the bottom of the apparatus body 900, there are provided a sheet cassette 301 and a cassette feeder 300. The sheet cassette 301 holds sheets P1. The cassette feeder 300 includes a cassette feeding roller 310 that feeds the sheets P1 one at a time.

In the front surface 903 of the apparatus body 900, there are provided a feeding tray cover (second opening and closing device) 401 and a tray feeder 400. The feeding tray cover 401 is openable and closable in relation to the apparatus body 900. The user can load sheets P2 on the feeder tray cover 401. The tray feeder 400 includes a tray feeding roller 410 that feeds the sheets P2 one at a time to be processed so that an image can be formed thereon by the image forming part 10A.

The operator (user) can select between the cassette feeder 300 and the tray feeder 400 to feed sheets for an image formation operation.

A sheet sent out of the cassette feeder 300 or the tray feeder 400 is carried to a register roller pair 501 to correct the skew of the sheet. The register roller pair 501 aligns the leading edge of the sheet with the leading edge of the toner image formed on the surface of the photosensitive drum 101. The sheet is thus carried into the image forming part 10A.

In the image forming part 10A, the toner image on the surface of the photosensitive drum 101 is transferred onto the sheet by the transferring roller 104.

On the downstream side of the image forming part 10A, a fixing device 600 is provided. The toner image transferred to the sheet is fixed to the sheet by a fixing roller pair 601 of the fixing device 600 (only one of the fixing rollers of the fixing roller pair 601 is shown in FIGS. 1-3, 5, and 6).

The sheet with the fixed toner image is then carried to a discharging roller pair 701 disposed on the downstream side of the fixing device 600 and is discharged onto a discharge tray 702 provided on the top surface 904 of the apparatus body. Only one of the discharging rollers of the discharging roller pair 701 is shown in FIGS. 1-3, 5, and 6.

As shown in FIG. 2, the image forming apparatus is provided with a cartridge cover (first opening and closing device) 801. The cartridge cover 801 is openable and closable in relation to the apparatus body 900 for replacing the process cartridge 100. The user opens this cartridge cover 801 to attach or detach the process cartridge 100, attaches or detaches the process cartridge 100, and then closes the cartridge cover.

The cartridge cover 801 includes a recess (first recess) 802, a hook 803 releasably engageable with a portion of the apparatus body 900, and a latch 804 connected to the hook 803 in such a manner as to release the hook from the apparatus body 900 when the user moves the latch 804 in the direction of the arrow F shown in FIG. 4, as will be discussed in more detail below. Both the cartridge cover 801 and the recess 802 form part of the top surface 904 of the apparatus body 900. When opening or closing the cartridge cover 801, the hand of the user is inserted into the recess 802, which is configured to receive the hand of the user and to permit the hand to contact and operate the latch 804 to disengage the hook 803 from the apparatus body 900 and to then open the cartridge cover. Once the user's hand is in the recess 802, the user grasps the latch 804 and pulls the latch 804 in the direction of the arrow F to disengage the hook 803 and open the cartridge cover 801. Thus, the hook 803 serves as an engaging part for engaging a part of the apparatus body 900 to fix the cartridge cover 801 to the apparatus body 900. The latch 804 is disposed in the first recess 802 and serves as a releasing device (manual operating member) for releasing the fixation of the cartridge cover 801 to the apparatus body 900 by the hook 803. The latch 804 includes a first operating part 804*a* located in the first recess 802. The first operating part 804*a* serves as one of two portions of the latch 804 that are configured to permit the user to operate the latch 804 to release the hook 803 to open the cartridge cover 801. When the cartridge cover 801 is closed from an open position, the hook 803 re-engages its corresponding part of the apparatus body 900 to fix the cartridge cover 801 to the apparatus body 900.

When opening the cartridge cover 801 to take out the process cartridge 100, the hand of the user moves the latch 804 located in the first recess 802 in the direction of arrow F (see FIG. 4). The hook 803 operates in conjunction with the latch 804 and is released from its engagement with the apparatus body 900 when the user moves the latch 804 in the direction of the arrow F. The fixation of the cartridge cover 801 to the apparatus body 900 by the hook 803 can be thus released, and the user can open the cartridge cover 801 in the direction of arrow H (see FIG. 2).

As shown in FIG. 3, the cartridge cover 801 includes a feeding tray cover 401 of the tray feeder 400 and the tray feeder 400 itself. The feeding tray cover 401 is openable and closable in relation to the apparatus body 900 independently of the opening and closing of the cartridge cover 801, but in approximately the same direction, as shown in FIGS. 2 and 3. The user can load sheets P2 onto the feeding tray cover 401 when the feeding cover tray 401 is open.

The feeding tray cover 401 includes a recess (second recess) 402, a hook 403 having an elastic member for engaging a part of the apparatus body 900 to fix the feeding tray cover 401 to the apparatus body 900, and a handle (operating portion) 402*a* that is integral with and does not move with respect to the feeding tray cover 401 or the recess 402. The hook 403 is attached to the feeding tray cover 401 in such a manner that it is disengaged from the apparatus body 900 when the user moves the handle 402*a* and the feeding cover tray 401 in the direction of the arrow G shown in FIG. 4, as will be discussed in more detail below. When opening or closing the feeding tray cover 401, the hand of the user is inserted into the second recess 402, which is configured to receive the hand and to permit contact with and operation of the handle 402*a*, and grasps the handle 402*a*. The user then pulls the handle 402*a* in the direction of the arrow G shown in FIG. 4 to release the hook 403, thereby disengaging the feeding tray cover 401 from the apparatus body and permitting the user to open the feeding tray cover 401. When the feeding tray cover 401 is closed from an open position, the hook 403 re-engages its corresponding part of the apparatus body 900 to fix the feeding tray cover 401 to the apparatus body 900. The second recess 402 is adjacent to the first recess 802. As shown in FIG. 1, the first and second recesses 802 and 402 are located in different surfaces of the case of the apparatus body 900. That is to say, while the first recess 802 is located in the top surface 904 of the apparatus body 900 in FIG. 1, the second recess 402 is located in the front surface 903 of the apparatus body 900 in FIG. 1.

As noted above, when opening the feeding tray cover 401 to load sheets P2, the hand of the user is inserted into the second recess 402 and pulls the handle 402*a* in the direction of arrow G (see FIG. 4). The hook 403 having the elastic member is disengaged from the apparatus body 900, and the user can then open the feeding tray cover 401.

As shown in FIG. 1, one end of the latch 804 includes an operating part 804*b* in the first recess 802 that extends into the second recess 402 of the feeding tray cover 401. The end 804*b* of the latch 804 serves as a second operating part for operating the latch 804 to disengage the hook 803 from the apparatus body 900.

The user can operate the end 804*b* of the latch 804 located in the second recess 402) to move the latch 804 in the direction of arrow F (see FIG. 4), thereby disengaging the hook 803 from the apparatus body 900 and opening the cartridge cover 801.

As described above, in the present embodiment, the user can open the cartridge cover 801 or the feeding tray cover 401 by inserting their hand into the second recess 402. Therefore, the operability of the covers can be improved.

But in the second recess 402 provided in the feeding tray cover 401, the handle 402*a* is fixed to, and is part of the recess 402, and does not move with respect to the feeding tray cover 401 and the recess 402 when moving in the direction of arrow G to release the hook 403 and the feeding tray cover 401 from engagement with and fixation to the apparatus body and to open the feeding tray cover 401. In contrast, the end 804*b* of the latch 804 is movable with respect to the feeding tray cover 401 and the recess 402 to release the hook 803 and the cartridge cover 801 from engagement with and fixation to the apparatus body and to open the cartridge cover 801. Thus, the opening operation of the cartridge cover 801 is different from the opening operation of the feeding tray cover 401, minimizing the chances that the operator will open the wrong cover by mistake.

In addition, the first recess 802 and the second recess 402 are located in different surfaces of the case of the apparatus body 900. Therefore, the opening and closing operation of the cartridge cover 801 can be performed from different surfaces (two directions), and operability is improved.

Figure 5:
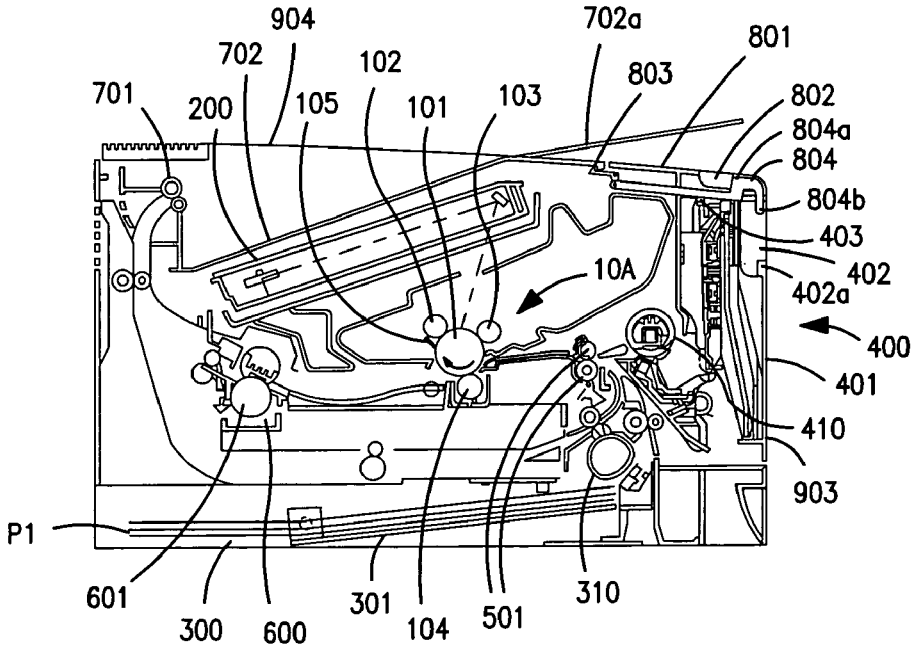
FIG. 5 is a schematic sectional view of the image forming apparatus with an extension member attached.

As shown in FIG. 5, an extension tray 702*a* extending toward the first recess 802 can be provided in the apparatus of the present embodiment. The extension tray 702*a* is an extension member extending from the discharging tray 702. Even in the case where sheets are long (for example, in the case of A3 size), the discharged sheets can be supported by this extension tray 702*a*.

In this case, the extension tray 702*a* overhangs the first recess 802. Therefore, the first operating part 804*a* of the latch 804 can be difficult to operate.

However, in the present embodiment, as described above, the end 804*b* of the latch 804 for releasing the cartridge cover 801 from engagement with the apparatus body 900 is located in the second recess 402 into which the hand of the operator is inserted when opening the feeding tray cover 401.

Therefore, even if there is a member that obstructs the first recess 801, the operator can surely open the desired opening and closing device as long as access to the second recess 402 is ensured.

Second Embodiment

Figure 6:
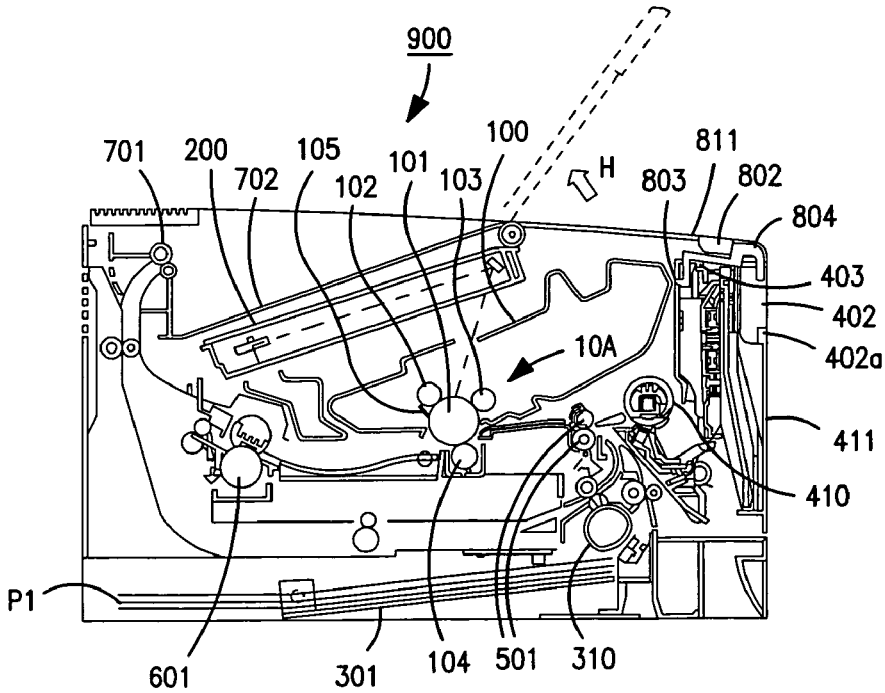
FIG. 6 is a schematic sectional view of an image forming apparatus according to a second embodiment of the present invention.
Figure 7:
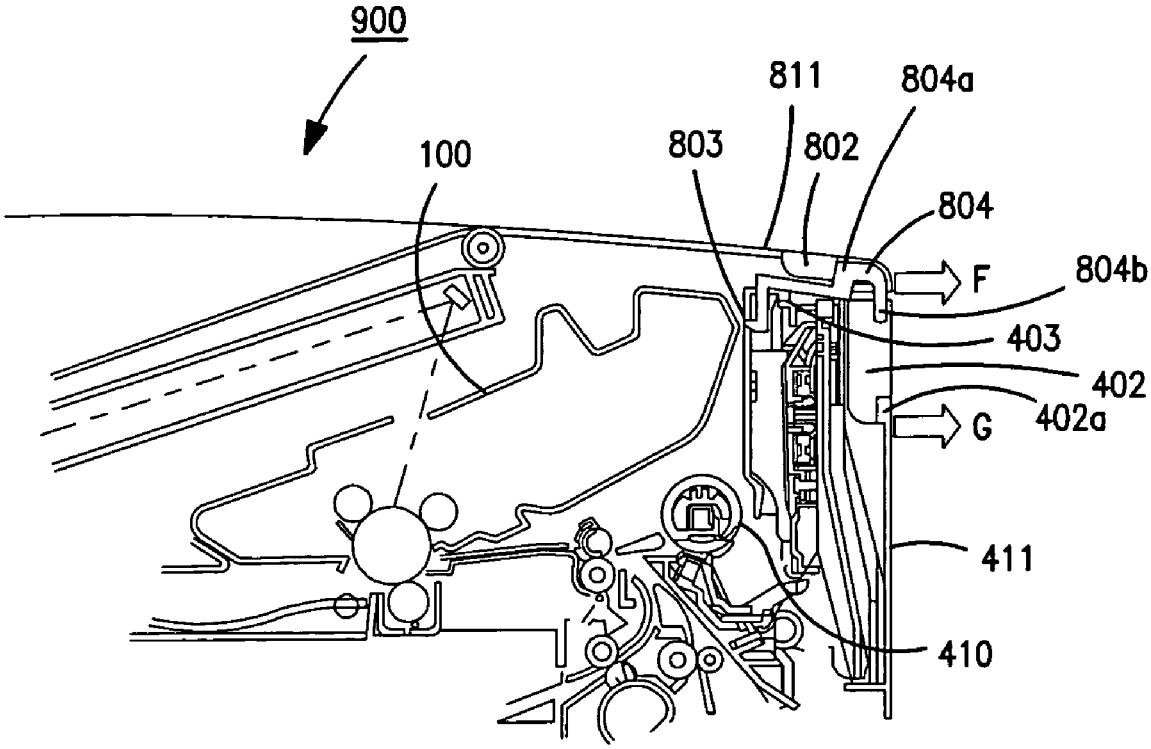
FIG. 7 is a schematic sectional enlarged view of an area including a first recess and a second recess into which the hand of the user is inserted.

FIG. 6 is a schematic sectional view showing the overall structure of an electrophotographic monochrome printer in a second embodiment of an image forming apparatus according to the present invention. FIG. 7 is a sectional view of a portion of the apparatus of FIG. 6. The present embodiment will be described with reference to these figures. The same reference numerals will be used to designate the same components as those in the first embodiment, so that their description will be omitted, and only the difference from the first embodiment will be described.

In the first embodiment, the cartridge cover 801 includes the feeding tray cover 401. In contrast, in the image forming apparatus shown in FIGS. 6 and 7, a cartridge cover 811 and a feeding tray cover 411 are disposed like a double door. More specifically, the cartridge cover 811 and the feeding tray cover 411 pivot in substantially opposite directions to move from their closed positions to their open positions. As a result, the cartridge cover 811 pivots upward, as shown in FIG. 6, to open, while the feeding tray cover 411 pivots downward in the opposite direction from cartridge cover 811 to open.

In the present embodiment, since the cartridge cover 811 and the feeding tray cover 411 are disposed like a double door, the first recess 802 is adjacent to the second recess 402 as in the first embodiment.

To open the cartridge cover 811, the user moves the first operating part 804*a* of the latch 804 in the first recess 802 in the direction of arrow F (see FIG. 7). The hook 803 operates in conjunction with the movement of the latch 804 in the direction of arrow F to disengage from the apparatus body 900. As a result, the fixation of the cartridge cover 811 to the apparatus body 900 by the hook 803 can be thus released, and the user can open the cartridge cover 811 in the direction of arrow H counterclockwise in the upward direction by moving the first operating part 804*a* in that direction (see FIG. 6).

Alternatively, the hand of the user is inserted into the second recess 402 and moves the end 804*b* of the latch 804 in the direction of arrow F (see FIG. 7), thereby releasing the cartridge cover 811 from its attachment to the apparatus body 900 by the hook 803, and the user can open the cartridge cover 811.

Of course, to open the feeding tray cover 411, the user inserts their hand into the second recess 402 and pulls the handle 402*a* in the direction of arrow G (see FIG. 7). As a result, the hook 403 having an elastic member is disengaged from the apparatus body 900, and the user can then open the feeding tray cover 411.

The above-described structure achieves the same advantages as the first embodiment.

In the first and second embodiments, a feeding tray cover and a cartridge cover are taken as examples of opening and closing devices. However, the present invention can be widely applied to the case where a plurality of opening and closing devices are provided in an image forming apparatus body and where operating parts for opening the opening and closing devices are adjacent to each other. That is to say, the opening and closing devices are not limited to a feeding tray cover and a cartridge cover, and the present invention can also be applied to, for example, a discharge tray cover on which discharged sheets are loaded and a jammed-sheet removing cover for removing a jammed sheet.

The present invention is not limited to the above-described embodiments. Various changes may be made without departing from the spirit of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-088418 filed Mar. 25, 2005, which is hereby incorporated by reference herein in its entirety.

What is claimed is:

1. An image forming apparatus comprising:

an image forming device provided in an apparatus body of said image forming apparatus and configured to form an image on recording material;

a first opening and closing device provided in the apparatus body and configured to be opened and closed with respect to the apparatus body;

an operating member operable by a user and configured to open said first opening and closing device in response to the user operating said operating member;

a first recess configured to receive the hand of the user and to permit the hand of the user to contact and operate said operating member to open said first opening and closing device with respect to the apparatus body after the hand of the user is inserted thereinto; and a second recess configured to receive the hand of the user and to permit the hand of the user to contact and operate said operating member to open said first opening and closing device with respect to the apparatus body after the hand of the user is inserted thereinto, said second recess being located at a position different from said first recess.

2. The image forming apparatus according to claim 1, further comprising a discharging portion configured to discharge the recording material after an image is formed thereon, wherein said discharging portion and said first recess are provided in the same surface of the apparatus body.

3. The image forming apparatus according to claim 2, further comprising an extension member that extends from said discharging portion toward said first recess.

4. The image forming apparatus according to claim 1, wherein said first recess and said second recess are provided in different surfaces of the apparatus body.

5. The image forming apparatus according to claim 1, wherein said operating member has a first operating part and a second operating part, said first operating part being located in said first recess, and said second operating part being located in said second recess.

6. The image forming apparatus according to claim 1, wherein said first opening and closing device is configured to be fixed to and released from being fixed to the apparatus body, wherein said operating member is configured to release said first opening and closing device from being fixed to the apparatus body in response to the user operating said operating member to permit said first opening and closing device to open;

wherein said first recess is configured to receive the hand of the user and to permit the hand of the user to contact and operate said operating member to release said first opening and closing device from being fixed to the apparatus body after the hand of the user is inserted thereinto; and a second recess configured to receive the hand of the user and to permit the hand of the user to contact and operate said operating member to release said first opening and closing device from being fixed to the apparatus body after the hand of the user is inserted thereinto.

7. The image forming apparatus according to claim 1, wherein said image forming device comprises a detachable process cartridge configured to form an image on the recording material, wherein said process cartridge is attachable to and detachable from the apparatus body after the user opens said first opening and closing device.

8. The image forming apparatus according to claim 1, further comprising a second opening and closing device provided in the apparatus body and configured to be opened and closed with respect to the apparatus body, wherein said second opening and closing device is different from said first opening and closing device, and wherein said second recess is configured to permit the hand of the user to contact and operate said second opening and closing device to open said second opening and closing device with respect to the apparatus body after the hand of the user is inserted thereinto.

9. The image forming apparatus according to claim 8, wherein said second opening and closing device is configured to receive the recording material and to feed the recording material.

10. The image forming apparatus according to claim 8, wherein said first opening and closing device opens in approximately the same direction as said second opening and closing device.

11. The image forming apparatus according to claim 8, wherein said first opening and closing device opens in approximately the opposite direction from said second opening and closing device.

12. The image forming apparatus according to claim 8, wherein said second opening and closing device comprises an operating portion, and wherein said second recess is configured to permit the hand of the user to contact and operate said operating portion of said second opening and closing device to open said second opening and closing device after the hand of the user is inserted thereinto.

13. The image forming apparatus according to claim 12, wherein said operating portion of said second opening and closing device is a handle of said second opening and closing device fixed to said second opening and closing device.

14. The image forming apparatus according to claim 13, wherein said operating member of first opening and closing device is movable with respect to said first recess and said second recess to open said first opening and closing device with respect to the apparatus body, and wherein said handle of said second opening and closing device is not movable with respect to said second recess to open said second opening and closing device with respect to said apparatus body.

15. The image forming apparatus according to claim 12, wherein said operating member of said first opening and closing device performs a different kind of opening operation with respect to said second recess than said operating portion of said second opening and closing device.

16. The image forming apparatus according to claim 8, wherein said second opening and closing device further comprises:

a hook having an elastic member configured to releasably engage a portion of the apparatus body; and a handle, wherein said handle and said hook are connected to each other such that movement of said handle in at least one direction by the user releases the engagement between said hook and the portion of the apparatus body engaged with said hook.

17. The image forming apparatus according to claim 1, wherein said first opening and closing device comprises a hook configured to releasably engage a portion of the apparatus body, wherein said operating member comprises a latch, wherein said latch and said hook are connected to each other such that movement of said latch in at least one direction by the user releases the engagement between said hook and the portion of the apparatus body engaged with said hook.

18. An image forming apparatus comprising:

image forming means for forming an image on recording material, said image forming means being provided in an apparatus body of said image forming apparatus;

first opening and closing means for opening and closing with respect to the apparatus body;

manual operating means, operable by a user, for opening said first opening and closing means with respect to the apparatus body in response to the user operating said manual operating means;

first receiving means for receiving the hand of the user and for permitting the hand of the user to contact and operate said manual operating means to open said first opening and closing means with respect to the apparatus body after the hand of the user is inserted thereinto; and second receiving means for receiving the hand of the user and for permitting the hand of the user to contact and operate said manual operating means to open said first opening and closing means with respect to the apparatus body after the hand of the user is inserted thereinto, said second receiving means being located at a position different from said first receiving means.

19. The image forming apparatus according to claim 18, wherein said first opening and closing means comprises means for being fixed to the apparatus body and for being released from being fixed to the apparatus body, wherein said manual operating means comprises means for releasing said first opening and closing means from being fixed to the apparatus body in response to the user operating said manual operating means to permit said first opening and closing means to open, wherein said first receiving means comprises means for receiving the hand of the user to permit the hand of the user to contact and operate said manual operating means to release said first opening and closing means from being fixed to the apparatus body after the hand of the user is inserted thereinto, wherein said second receiving means comprises means for receiving the hand of the user to permit the hand of the user to contact and operate said manual operating means to release said first opening and closing means from being fixed to the apparatus body after the hand of the user is inserted thereinto, wherein said apparatus further comprises second opening and closing means for being fixed to and released from being fixed to the apparatus body, for opening with respect to the apparatus body when released from being fixed thereto, and for closing with respect to the apparatus body, wherein said second opening and closing means is different from said first opening and closing means, and wherein said second receiving means permits the hand of the user to contact and operate said second opening and closing means to release said second opening and closing means from being fixed to the apparatus body after the hand of the user is inserted thereinto.

* * * * *